US009194280B2

(12) United States Patent
Berkemeier et al.

(10) Patent No.: US 9,194,280 B2
(45) Date of Patent: Nov. 24, 2015

(54) APPLIED-IGNITION INTERNAL COMBUSTION ENGINE WITH CATALYTICALLY COATED INJECTION DEVICE, AND METHOD FOR OPERATING AN INTERNAL COMBUSTION ENGINE OF SAID TYPE

(71) Applicant: Ford Global Technologies, LLC, Dearborn, MI (US)

(72) Inventors: Oliver Berkemeier, Bergisch Gladbach (DE); Klemens Grieser, Langenfeld (DE); Kay Hohenboeken, Cologne (DE); Jens Wojahn, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 327 days.

(21) Appl. No.: 13/789,008

(22) Filed: Mar. 7, 2013

(65) Prior Publication Data

US 2013/0233275 A1 Sep. 12, 2013

(30) Foreign Application Priority Data

Mar. 12, 2012 (DE) ..... 10 2012 203 802

(51) Int. Cl.
*F02M 53/04* (2006.01)
*F02B 17/00* (2006.01)

(52) U.S. Cl.
CPC ..... *F02B 17/005* (2013.01); *F02M 53/04* (2013.01)

(58) Field of Classification Search
CPC ..... F02B 17/00; F02B 17/005; F02M 19/03; F02M 53/04
USPC ..... 123/557, 295, 555, 558, 543–549; 701/101; 239/585.1–585.5
See application file for complete search history.

(56) References Cited

U.S. PATENT DOCUMENTS

| | | | | |
|---|---|---|---|---|
| 6,145,763 | A * | 11/2000 | Fleming et al. | 239/585.1 |
| 7,681,558 | B2 * | 3/2010 | Gale et al. | 123/557 |
| 2010/0126471 | A1 * | 5/2010 | Cheiky et al. | 123/476 |
| 2011/0265761 | A1 * | 11/2011 | Amann et al. | 123/406.11 |
| 2012/0316760 | A1 * | 12/2012 | Grieser et al. | 701/108 |
| 2013/0048748 | A1 * | 2/2013 | Imoehl | 239/5 |
| 2013/0311062 | A1 * | 11/2013 | Skipp et al. | 701/103 |
| 2015/0021417 | A1 * | 1/2015 | Ukropec et al. | 239/584 |

FOREIGN PATENT DOCUMENTS

| | | | |
|---|---|---|---|
| DE | 19951014 | A1 | 1/2001 |
| DE | 19945813 | A1 | 3/2001 |

(Continued)

*Primary Examiner* — Stephen K Cronin
*Assistant Examiner* — Xiao Mo
(74) *Attorney, Agent, or Firm* — Julia Voutyras; Alleman Hall McCoy Russell & Tuttle LLP

(57) ABSTRACT

Systems and methods are provided for reducing coking residues on an injection device of an applied-ignition, direct injection engine. An example system comprises an injection device; an electric heating device integrated with the injection device; a catalytic coating on a surface of the injection device; and a controller suitable to initiate a cleaning mode of the injection device wherein the electric heating device raises the temperature of the injection device. Heating the injection device allows coking residues on the injection device to oxidize in the presence of the catalytic coating.

20 Claims, 4 Drawing Sheets

(56) References Cited

FOREIGN PATENT DOCUMENTS

| | | | |
|---|---|---|---|
| DE | 10117519 | A1 | 10/2002 |
| DE | 102005023793 | A1 | 11/2006 |
| WO | 03002859 | A1 | 1/2003 |

* cited by examiner

APPLIED-IGNITION INTERNAL COMBUSTION ENGINE WITH CATALYTICALLY COATED INJECTION DEVICE, AND METHOD FOR OPERATING AN INTERNAL COMBUSTION ENGINE OF SAID TYPE

CROSS REFERENCE TO RELATED APPLICATIONS

The present application claims priority to German Patent Application No. 102012203802.7, filed on Mar. 12, 2012, the entire contents of which are hereby incorporated by reference for all purposes.

TECHNICAL FIELD

The present application relates to the injection devices of applied-ignition direct injection engines.

BACKGROUND AND SUMMARY

In the development of internal combustion engines, it is constantly sought to minimize fuel consumption and reduce pollutant emissions.

Fuel consumption is of particular importance in applied-ignition engines. This is the result of the traditional applied-ignition engine being operated with a homogeneous fuel-air mixture, in which the desired power is set by varying the charge of the combustion chamber by quantity regulation. Combustion chamber charge is altered by adjusting a throttle flap which is provided in the intake tract. The pressure of the inducted air downstream of the throttle flap can be reduced to a greater or lesser extent. At a constant combustion chamber volume, it is possible in this way for the air mass, that is to say the quantity, to be set by the pressure of the inducted air. However, quantity regulation by a throttle flap has thermodynamic disadvantages in the partial load range owing to throttling losses.

One approach for dethrottling the applied-ignition engine is the development of hybrid combustion processes. These hybrid combustion processes are based on the transfer of technical features of the traditional diesel engine, characterized by air compression, a non-homogeneous mixture, auto-ignition and quality regulation. The low fuel consumption of diesel engines results from the quality regulation, wherein the load is controlled by the fuel quantity injected.

The injection of fuel directly into the combustion chamber of the cylinder is therefore considered to be a suitable measure for noticeably reducing fuel consumption even in applied-ignition engines. A certain degree of dethrottling of the internal combustion engine can be achieved already by virtue of quality regulation being used in certain operating ranges. A direct-injection applied-ignition internal combustion engine is also the subject matter of the present disclosure.

With the direct injection of the fuel into the combustion chamber, it is possible in particular to realize a stratified combustion chamber charge, which can contribute significantly to the dethrottling of the applied-ignition engine working process because the internal combustion engine can be leaned to a very great extent by the stratified charge operation, which offers thermodynamic advantages in particular in partial load operation, that is to say in the lower and middle load range, when small amounts of fuel are to be injected.

A stratified charge is distinguished by a highly non-homogeneous combustion chamber charge which cannot be characterized by a uniform air ratio but which has both lean ($\lambda>1$) mixture parts and also rich ($\lambda<1$) mixture parts, wherein an ignitable fuel-air mixture with a relatively high fuel concentration is present in the region of the ignition device.

A relatively small amount of time is available for the injection of the fuel, for the mixture preparation in the combustion chamber, that is to say the mixing of air and fuel and the preparation including evaporation, and for the ignition of the prepared mixture.

Since a small amount of time is available for the preparation of an ignitable and combustible fuel-air mixture as a result of the direct injection of the fuel into the combustion chamber, direct-injection applied-ignition engine processes are significantly more sensitive to changes and deviations in the mixture formation, in particular in the injection and the ignition, than conventional applied-ignition engine processes.

The non-homogeneity of the fuel-air mixture is also a reason why the particle emissions known from the diesel engine process are likewise of relevance in the case of the direct-injection applied-ignition engine, whereas said emissions are of almost no significance in the case of the traditional applied-ignition engine.

In the case of the direct injection of fuel, problems are caused by the coking of the injection device, for example of an injection nozzle which is used for the injection. Small quantities of fuel which adhere to the injection device during the injection may undergo incomplete combustion under oxygen-deficient conditions.

Deposits of coking residues form on the injection device. Said coking residues may firstly disadvantageously change the geometry of the injection device and influence or hinder the formation of the injection jet, and thereby sensitively disrupt mixture preparation.

Secondly, injected fuel accumulates in the porous coking residues, which fuel, often toward the end of the combustion when the oxygen provided for the combustion has been almost completely consumed, then undergoes incomplete combustion and forms soot, which in turn contributes to the increase in particle emissions.

Furthermore, coking residues may become detached for example as a result of mechanical loading caused by a pressure wave propagating in the combustion chamber or the action of the injection jet. The residues detached in this way may lead to damage in the exhaust-gas discharge system, and for example impair the functional capability of exhaust-gas aftertreatment systems provided in the exhaust-gas discharge system.

Known are concepts which are intended to counteract the build-up of coking residues and/or which serve to deplete deposits of coking residues, that is to say to remove said coking residues from and clean the combustion chamber.

The German laid-open specification DE 199 45 813 A1 describes a method for operating a direct-injection internal combustion engine, in which method, upon the detection of deposits in the combustion chamber, for example on an injection valve, measures are implemented in a targeted manner for cleaning the combustion chamber, wherein the presence of deposits in the combustion chamber is inferred from a misfire detection system. Measures proposed for cleaning the combustion chamber include the targeted initiation of knocking combustion and/or the introduction of a cleaning fluid into the inducted combustion air. Both measures may contribute to fuel consumption and pollutant emissions. Knocking may be initiated by advancing spark timing from a current timing to past (more advanced than) a borderline threshold.

Proposed as a particularly advantageous cleaning fluid is water, the injection of which causes the combustion temperature to be lowered, as a result of which the emissions of nitrogen oxides ($NO_x$) can be simultaneously reduced. The injection of water is however not suitable in partial load operation at low loads and low rotational speeds, because this harbors the risk of corrosion in the combustion chamber and in the exhaust-gas discharge system, and may yield disadvantages in terms of wear.

The European patent EP 1 404 955 B1 describes an internal combustion engine whose at least one combustion chamber has, at least in regions, a catalytic coating on the surface for the purpose of oxidation of coking residues. The catalytic layer is intended to promote the oxidation of coking residues, specifically to effect a fast oxidation of the carbon-containing lining at a boundary surface between the catalytic converter and lining at typical operating temperatures, and to thereby effect an early detachment of the deposit under the action of the prevailing flow. In this way, growth of the residues is reduced or even completely prevented.

A disadvantage of the method described in EP 1 404 955 B1 for the reduction of coking residues by oxidation is that, even when using catalytic materials, the minimum temperatures required for the oxidation may not be reached in partial load operation at low loads and low rotational speeds. It is however precisely these operating conditions of the internal combustion engine, specifically low loads and/or low rotational speeds, that promote, that is to say expedite, the formation of deposits of the type in question, and that necessitate a method for removing said deposits.

The German laid-open specification DE 101 17 519 A1 describes a method for operating a direct-injection internal combustion engine in which the inlet valve unit of a cylinder is purposely equipped to prevent the dissipation of heat, that is to say, is designed to increase the surface temperature in the region of the throat of the inlet valve. It is thereby sought to ensure that, at least in the throat, the high temperatures required for the depletion of coking residues are attained more often, or regularly, during normal operation of the internal combustion engine.

Nevertheless, that region in the load-rotational speed characteristic map in which the required temperatures are actually reached is merely widened, that is to say enlarged. The region in which the minimum temperatures of 380° C. required for the depletion of coking residues lies close or adjacent to the full-load line at high rotational speeds and high loads. Method-based measures for targetedly increasing the component temperature in other characteristic map regions are not implemented in DE 101 17 519 A1. Rather, it is relied upon that the required temperatures are generated of their own accord during normal operation of the internal combustion engine in corresponding regions of the load-rotational speed characteristic map.

In this respect, the method of DE 101 17 519 A1 also does not permit the depletion of coking residues, that is to say cleaning by oxidation, at low loads and low rotational speeds of the internal combustion engine.

The above-described problem takes on an even greater significance during the warm-up phase of the internal combustion engine, in particular directly after a cold start of the internal combustion engine, when the component temperatures are particularly low. This is because the low temperature level expedites the formation of coking residues and also makes the removal of said residues more difficult.

By contrast to the internal combustion engines described in EP 1 404 955 B1 and DE 101 17 519 A1, in which the component temperature is not or cannot be influenced, in particular raised, in a targeted manner by method-based measures, according to the disclosure, it is not relied upon that the temperatures required for the oxidation of coking residues are generated of their own accord during normal operation of the internal combustion engine. Rather, the component temperature of the injection device is influenced by the electric heating device, such that the depletion of coking residues can be controlled and performed in a targeted manner under all operating conditions.

The inventors have recognized the above described disadvantages and in the present disclosure describe systems and methods in which deposits of coking residues on the injection device may be removed in an effective and targeted manner under all operating conditions, in particular also during partial load operation.

In the internal combustion engine according to the disclosure, the temperature of the injection device may be raised in a targeted manner in the region of the catalytic coating by the electric heating device, such that the minimum temperatures required for the oxidation of coking residues may be attained or generated under all operating conditions, in particular also during partial load operation or at low loads and low rotational speeds.

Furthermore, the injection device of the present disclosure is equipped with an electric heating device which allows fuel to be introduced into the combustion to be pre-heated during the injection process. This advantageously assists the mixture preparation, in particular the evaporation of the injected fuel, and the initiation of the pre-reactions required for the combustion. The heating of the fuel by a heating device is particularly advantageous during the warm-up phase of the internal combustion engine after a cold start and in operating ranges with low temperatures, for example operating ranges with low loads and low rotational speeds.

Systems and methods are provided for reducing coking residues on an injection device of an applied-ignition, direct injection engine. An example system comprises an injection device; an electric heating device integrated with the injection device; a catalytic coating on a surface of the injection device; and a controller suitable to initiate a cleaning mode of the injection device wherein the electric heating device raises the temperature of the injection device. Heating the injection device allows coking residues on the injection device to oxidize in the presence of the catalytic coating.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Further, the inventors herein have recognized the disadvantages noted herein, and do not admit them as known.

DETAILED DESCRIPTION

Figure 1:
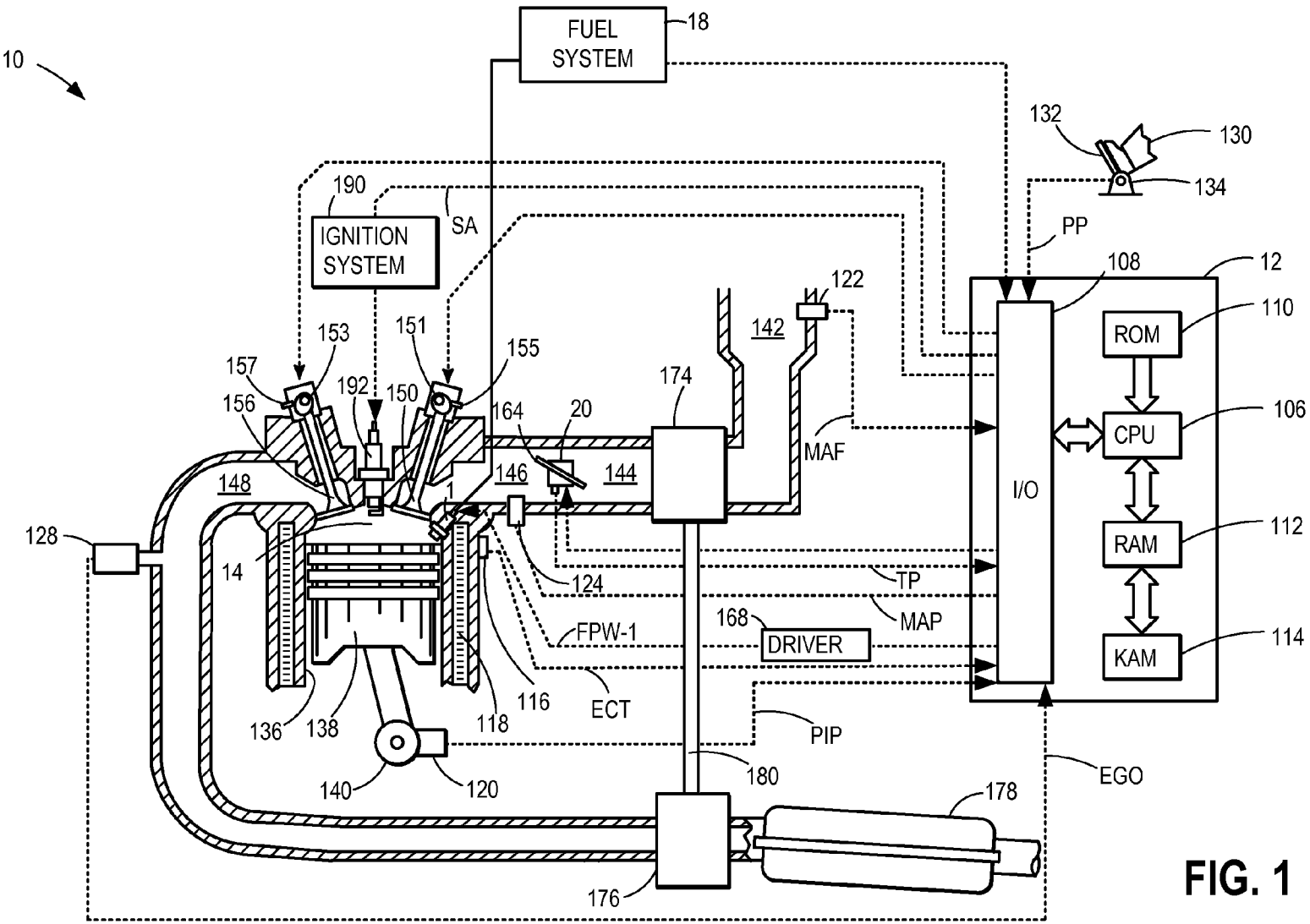
FIG. 1 shows and example cylinder of an engine in accordance with the present disclosure.

Referring now to the figures, FIG. 1 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 1, or alternatively may be provided upstream of compressor 174.

Exhaust passage 148 may receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be measured by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system. A cam timing may be adjusted (by advancing or retarding the VCT system) to adjust an engine dilution in coordination with an EGR flow thereby reducing EGR transients and improving engine performance.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

As a non-limiting example, cylinder 14 is shown including one injection device 1. Injection device 1 is shown coupled directly to cylinder 14 for injecting fuel directly therein in proportion to the pulse width of signal FPW received from controller 12 via electronic driver 168. In this manner, injection device 1 provides what is known as direct injection (hereafter also referred to as "DI") of fuel into combustion cylinder 14. While FIG. 1 injection device 1 as a side injector, it may also be located overhead of the piston, such as near the position of spark plug 192. Fuel may be delivered to injection device 1 from a high pressure fuel system 18 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injection device 1 may be a port injector providing fuel into the intake port upstream of cylinder 14.

As described above, FIG. 1 shows one cylinder of a multi-cylinder engine. As such each cylinder may similarly include its own set of intake/exhaust valves, fuel injector(s), spark plug, etc.

While not shown, it will be appreciated that engine may further include one or more exhaust gas recirculation passages for diverting at least a portion of exhaust gas from the engine exhaust to the engine intake. As such, by recirculating some exhaust gas, an engine dilution may be affected which may reduce engine knock, peak cylinder combustion temperatures and pressures, throttling losses, and NOx emissions. The one or more EGR passages may include an LP-EGR passage coupled between the engine intake upstream of the turbocharger compressor and the engine exhaust downstream of the turbine, and configured to provide low pressure (LP) EGR. The one or more EGR passages may further include an HP-EGR passage coupled between the engine intake downstream of the compressor and the engine exhaust upstream of the turbine, and configured to provide high pressure (HP) EGR.

In one example, an HP-EGR flow may be provided under conditions such as the absence of boost provided by the turbocharger, while an LP-EGR flow may be provided during conditions such as in the presence of turbocharger boost and/or when an exhaust gas temperature is above a threshold. The LP-EGR flow through the LP-EGR passage may be adjusted via an LP-EGR valve while the HP-EGR flow through the HP-EGR passage may be adjusted via an HP-EGR valve (not shown).

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Controller 12 and its storage medium read-only memory 110 can be programmed with computer readable data representing instructions executable by processor 106 for performing the methods described below as well as other variants that are anticipated but not specifically listed.

Figure 2:
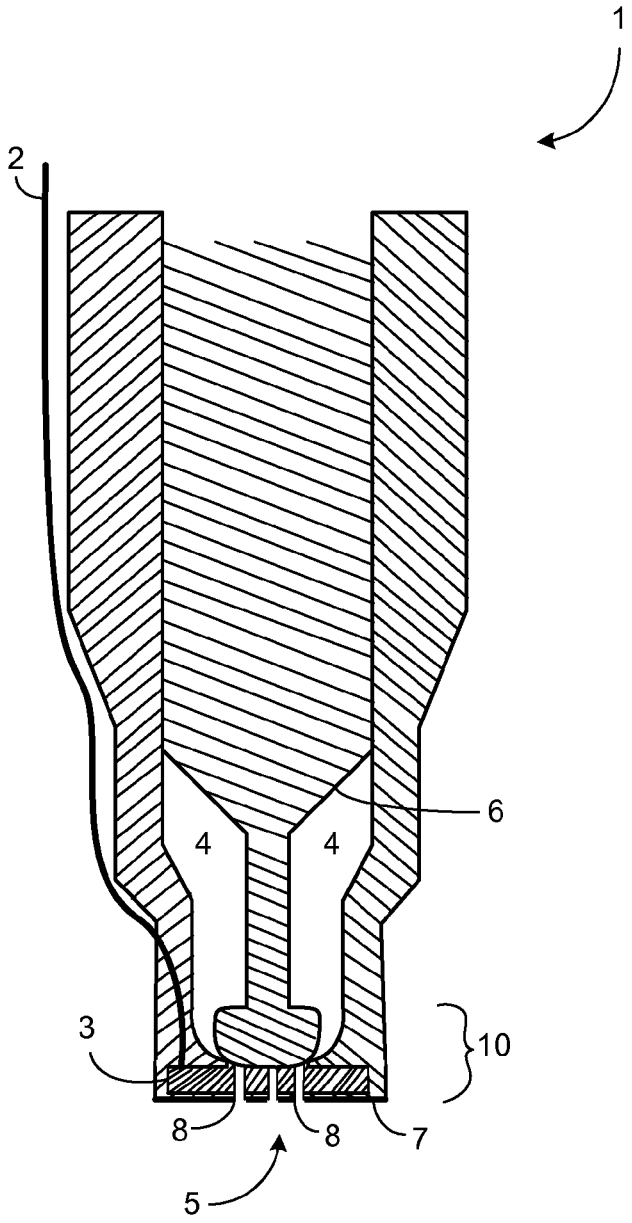
FIG. 2 schematically shows a cross section through an injection device

FIG. 2 schematically shows a cross section through an injection device 1, of a first embodiment of the internal combustion engine. The injection device 1 illustrated in FIG. 2 is a gasoline injection nozzle in which, at the free end of the injection device 1, the pintle 6 forces fuel held in the fuel opening 4 out of nozzle openings 8.

The injection device 1 has, in the region of the fuel nozzle 5, a tip region 10 which projects into the combustion chamber. This surface of tip region 10 may be wholly or partially coated in a catalytic coating 7. The catalytic coating 7 assists the oxidation of coking residues. FIG. 2 is shown in cross section, however it should be appreciated that the catalytic coating 7 may span the surface of the injection device 1, or in an alternative embodiment may be confined to a region of the injection device. Furthermore, heating device 3 may be configured as a disk of any shape in the base of the injection device 1 or may, alternatively, be arranged in strips or a grid in the injection device. The tip region 10 of injection device 1 is shown in greater detail in reference to FIG. 3.

Figure 3:
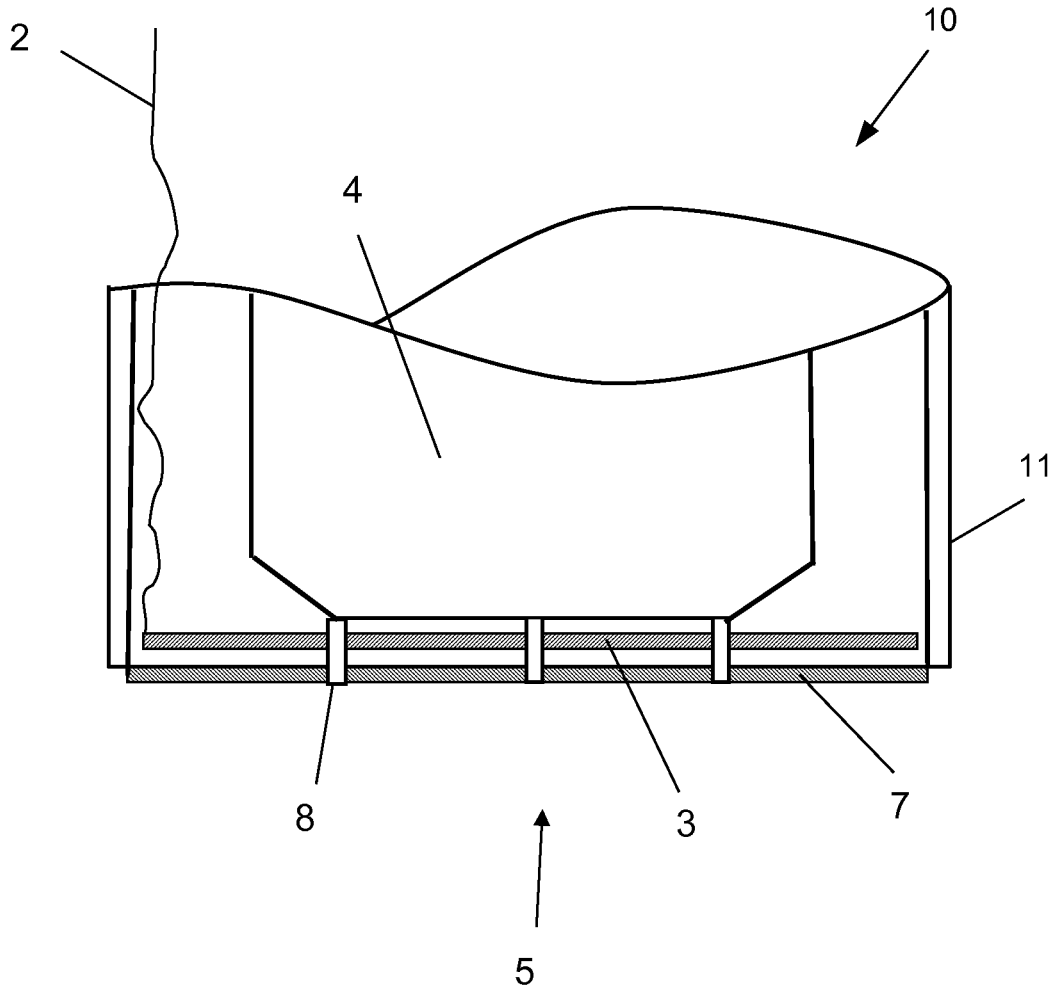
FIG. 3 shows a cross section of the tip of an injection device in accordance with the present disclosure.

Turning now to FIG. 3, a more detailed view of the tip region 10 of the injection device 1 is shown. In FIG. 3, the pintle is not shown in fuel opening 4. Nozzle openings 8 are shown as holes through both the heating device 3 and the catalytic coating 7 which allow the spray of fuel into the combustion chamber. The catalytic coating 7 is on the bottom surface of the fuel nozzle 5. The catalytic coating may in other embodiments span the side walls 11 of the tip region 10 if they project into a combustion chamber and are thus susceptible to accumulation of coking residues.

In a non-limiting example, a region of the surface of the injection device which projects into the combustion chamber may have a catalytic coating. A region may comprise less than one half of the surface of the injection device which projects into the combustion chamber. Catalytic coatings may be expensive and coating a specific region of the injection device may reduce costs.

To initiate and assist the oxidation of coking residues for the purpose of cleaning, the injection nozzle 1 is equipped with an electric heating device 3 which is supplied with electrical current via electrical lines 2 and which increases the component temperature of the injection nozzle 5 in the region of the catalytic coating 7. One of the electrical lines may be grounded to the injector body via side walls 11.

In another embodiment the injector may be an electronic fuel injector and an electrical source for operating the solenoid within the electronic fuel injector may also power the electric heating device. Furthermore, electric lines for the electric heating device may be integrated within the housing of the injection device or located exterior to the injection device.

Embodiments of the internal combustion engine are also advantageous in which less than one quarter of the surface of the injection device which projects into the combustion chamber has a catalytic coating.

Embodiments of the internal combustion engine are likewise advantageous in which less than one sixth of the surface of the injection device which projects into the combustion chamber has a catalytic coating.

In general, the region of the injection nozzle projecting into the combustion chamber may be exposed to formation of deposits or the build-up of coking residues, because in said regions, the fuel opening integrated in the nozzle emerge from the nozzle and form the fuel nozzle which are opens toward the combustion chamber.

In an alternative embodiment and injection device may have a flat face end at its tip where the fuel nozzle may be found. Embodiments are advantageous in which said flat face side has a catalytic coating. In such an example the flat face side of the injection device preferably terminates flush with the surrounding combustion chamber internal wall, wherein on the face side of the injection device, a plurality of fuel ducts emerge so as to form nozzle openings which serve for the introduction of fuel into the combustion chamber.

Embodiments of the internal combustion engine are advantageous in which the electric heating device is integrated into the injection device in such a way that the component temperature is increased substantially in the region of the catalytic coating.

Said embodiment makes allowance for the fact that the purpose of the heating device is, in interaction with the catalytic coating, to counteract the deposits on the outer surface of the injection device and eliminate the coking residues there, that is to say to ensure the surface cleaning as a result of oxidation. Against this background, it is expedient for the heating device to be designed, and integrated into the injection device, such that the temperature is increased primarily in the relevant regions, that is to say, in the catalytic coating on the outer surface of the injection device.

A certain introduction of heat into the interior of the injection nozzle may however also be advantageous for example in order to pre-heat the fuel conducted in the ducts as it passes through the injection device.

Embodiments of the internal combustion engine are advantageous in which the injection device is an injection nozzle.

The present disclosure further specifies a method for operating an applied-ignition internal combustion engine of a type described above, in which the injection device is equipped with an electric heating device, is achieved by a method wherein the component temperature of the injection device is increased in the region of the catalytic coating by the heating device in order to initiate and assist the oxidation of coking residues for the purpose of cleaning.

Figure 4:
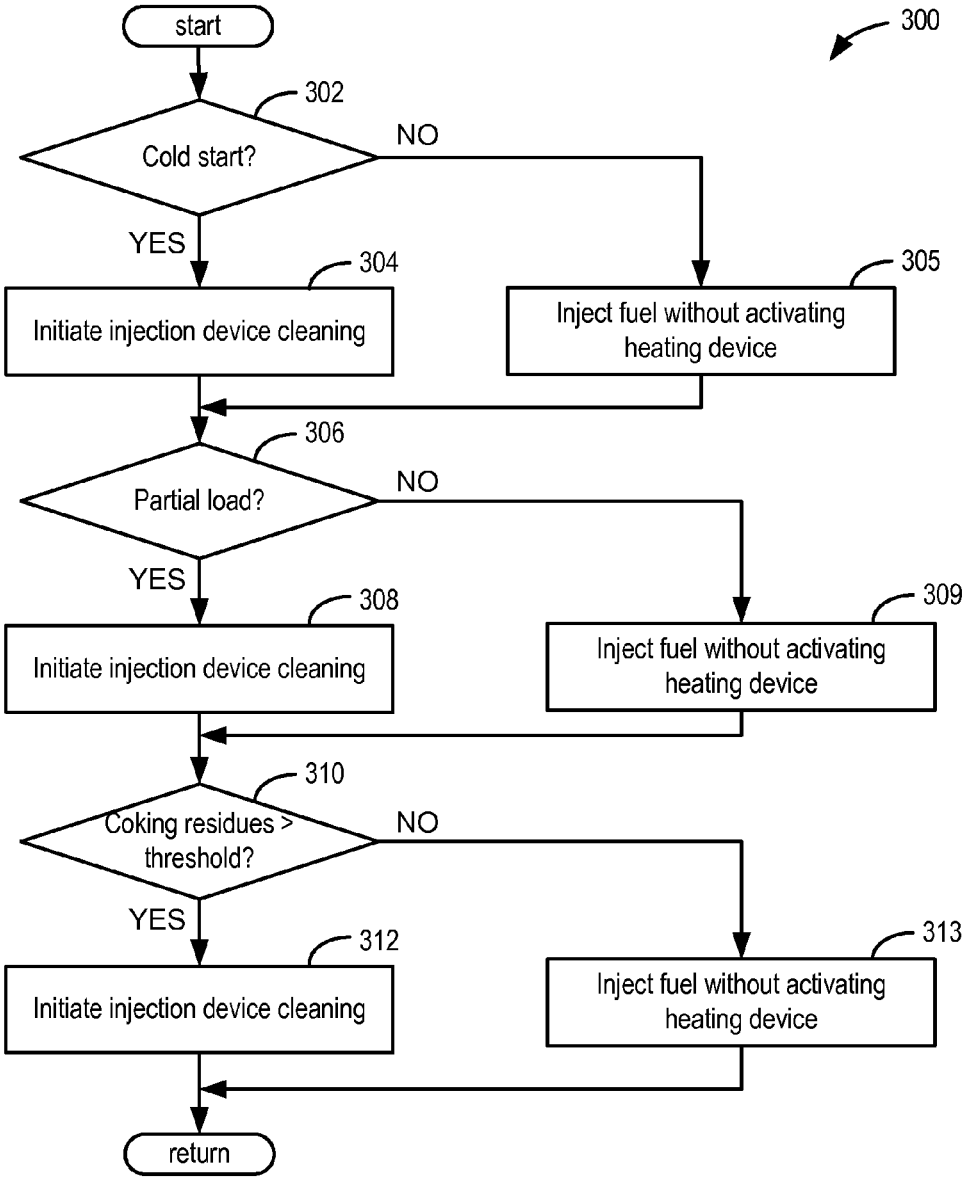
FIG. 4 shows a flowchart of a method of cleaning an injection device.

FIG. 4 schematically depicts a method 300 in accordance with the present disclosure. The method starts with an engine on event. At 302 it is assessed if it was a cold start. If the engine on event was a cold start (YES) injector cleaning is initiated 304. If it was not a cold start the method proceeds to step 305 where the fuel injection continues in the absence of applied heat from the electric heating device and the method proceeds to step 306.

Embodiments of the method are advantageous in which the component temperature of the injection device is increased at least temporarily during the warm-up phase after a cold start. After a cold start, the component temperatures, in particular also the temperatures of the injection device, are particularly low, such that during said operating phase of the internal combustion engine, there is a particularly high demand for increasing the component temperatures by the heating device, that is to say heating or warming the injection device in particular in the region of the catalytic coating.

Embodiments of the method are advantageous in which the component temperature of the injection device is increased at least temporarily during the warm-up phase after a cold start. After a cold start, the component temperatures, in particular also the temperatures of the injection device, are particularly low, such that during said operating phase of the internal combustion engine, there is a particularly high demand for increasing the component temperatures by the heating device, that is to say heating or warming the injection device in particular in the region of the catalytic coating.

Injector cleaning may comprise heating the injection device which may be achieved by the electric heating device 3. Heating the injection device may further comprise bypassing charge air cooling and/or raising a liquid cooling temperature. Furthermore, cleaning the injection device may comprise additional methods, described below, of heating the injection device to a temperature at which the catalyst may serve to oxidize coking residues.

Using the heating device or as a result of the increase of the component temperatures, it is possible for an oxidation for the purposes of cleaning to be initiated and assisted, and also for deposits in the form of coking residues to be counteracted already from the onset thereof Embodiments of the method are advantageous in which the injection pressure with which the injection device injects fuel into the combustion chamber is increased in order to assist the cleaning by oxidation. It is assumed here that the fuel jet entering the combustion chamber acts on the deposits and partially detaches the deposits, wherein the action of the fuel jet increases with the injection pressure.

Embodiments of the method are advantageous in which knocking combustion is initiated in order to assist the cleaning by oxidation. The pressure oscillations generated as a result of the knocking combustion are superposed on the normal pressure profile and generate intense high-frequency vibrations which can remove the deposits. The knocking combustion may be used briefly to assist the cleaning by oxidation, because said knocking combustion also subjects the other components to high loading and may cause damage.

Embodiments of the method are advantageous in which the component temperature of the injection device is raised by virtue of the ignition time being shifted in the early direction.

An adjustment of the ignition time in the early direction, that is to say toward smaller crank angles proceeding from a working cycle which covers 720° CA, shifts the combustion focus, that is to say the combustion process, into the vicinity of top dead center, and/or into the compression phase. Using this measure, the process pressures and process temperatures can be increased. The higher combustion temperatures inevitably also lead to higher component temperatures, in particular to higher temperatures of the components and walls which delimit the combustion chamber, and therefore also to a higher component temperature of the injection device.

In this connection, embodiments of the method are advantageous in which the component temperature of the injection device is raised by virtue of the ignition time being shifted in the early direction proceeding from an ignition time which is optimized with regard to fuel consumption. Said method variant makes allowance for the fact that the operating parameters of an internal combustion engine are preferably calibrated and fixed so as to obtain low fuel consumption and good emissions characteristics.

If a shift of the ignition time in the early direction is used for raising the temperature, the ignition time can be shifted in the late direction, back to the ignition time which is optimized with regard to fuel consumption, after the method according to the disclosure as per the variant in question has been carried out.

If the internal combustion engine is equipped with a liquid-type cooling arrangement, embodiments of the method are advantageous in which the increase of the component temperature of the injection device is assisted by virtue of the temperature of the cooling liquid of the liquid-type cooling arrangement being raised. The less heat is dissipated by =cooling liquid, the higher are the component temperatures and therefore also the component temperature of the injection device relevant here. Furthermore, as a result of the raising of the temperature of the cooling liquid, less fuel is accumulated or deposited in the coking residues.

In the case of internal combustion engines equipped with a charge-air cooling arrangement, embodiments of the method are advantageous in which the increase of the component temperature of the injection device is assisted by virtue of the charge-air cooling arrangement being bypassed.

In the case of supercharged internal combustion engines a charge-air cooler is often provided in the intake line downstream of the compressor, the charge-air cooler cools charge air before it enters the at least one cylinder. The cooler lowers the temperature and thereby increases the density of the charge air, such that the cooler also contributes to improved charging, that is to say to a greater air mass. Compression by cooling takes place here.

By contrast, if it is sought to raise the component temperature of the injection device, it is advantageous for the charge-air cooling arrangement to be bypassed in accordance with the present method variant.

Referring again to FIG. 4, at 306, it is determined if the engine is under partial load. Partial load may comprise low load and low rotational speeds. If the engine is under partial load (YES) cleaning the injection device is initiated at 308. If the engine is not under partial load (NO) the method proceeds to 309 where the fuel injection continues in the absence of applied heat from the electric heating device and the method proceeds to step 310.

As has already been stated, in the internal combustion engine according to the disclosure, the deposits of coking residues can be counteracted even during partial load operation, specifically by a heating device for generating the required minimum temperatures.

Carrying out the method at low load and low rotational speed of the internal combustion engine, as per the method variant in question, is advantageous because these operating conditions of the internal combustion engine expedite the formation and deposit of coking residues. At low load and low rotational speed, therefore, removing said deposits is advantageous.

At 310, it is determined if the coking residues on the injection device are above a predefined threshold. The threshold may be estimated based on engine operating conditions including: load, speed and air-fuel ratio; time elapsed since last injection device heating phase; or input from exhaust gas oxygen sensors, temperatures sensors etc. If coking residues are not above the predefined threshold (NO) the method proceeds to step 313 where the fuel injection continues in the absence of applied heat from the electric heating device. If coking residues are above a predefined threshold (YES at 310) the method proceeds to 312 where injection device cleaning, as described above, is initiated.

Embodiments of the method are advantageous in which the amount of coking residues deposited on the injection device is estimated by a mathematical model, and the amount determined in this way is compared with the predefinable amount, the cleaning by oxidation being initiated as soon as the predefinable amount is exceeded.

Embodiments of the method are also advantageous in which the cleaning by oxidation is initiated as soon as a predefinable operating duration of the internal combustion engine is exceeded or when a vehicle in which the internal combustion engine is used has traveled a predefinable distance.

Once initiated a cleaning mode of the injection device may be stopped by varied mechanisms. In one example, a cleaning mode of the injection device may persist for a given time period once initiated. Alternatively, the cleaning mode may persist until an estimated coking residue level has been reduced to an acceptable amount, an engine is no longer under partial load, operating temperatures are such that oxidation of coking residues may occur spontaneously in the presence of catalyst, etc. Once a cleaning mode of the injection device has occurred or it is determined that no cleaning mode may be initiated the method returns.

The above described disclosure provides a system and methods to reduce coking residues on an injection device in a direct injection applied-ignition engine. Use of a catalyst coating and integrated heating device allow coking residues to oxidize from the injection device thus improving emissions and fuel economy.

Systems and methods are provided for reducing coking residues on an injection device of an applied-ignition, direct injection engine. An example system comprises an injection device; an electric heating device integrated with the injection device; a catalytic coating on a surface of the injection device; and a controller suitable to initiate a cleaning mode of the injection device wherein the electric heating device raises the temperature of the injection device. Heating the injection device allows coking residues on the injection device to oxidize in the presence of the catalytic coating.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine comprising:

at least one cylinder;

an ignition device for initiating applied-ignition;

an injection device for directly injecting fuel into a combustion chamber of the at least one cylinder;

a catalytic coating on at least a region of the injection device at a tip region of the injection device; and an electric heating device at the tip region to increase a temperature of the catalytic coating at the tip region of the injection device.

2. The engine as claimed in claim 1, wherein less than one half of a surface of the injection device which projects into the combustion chamber has the catalytic coating.

3. The engine as claimed in claim 1, wherein less than one quarter of a surface of the injection device which projects into the combustion chamber has the catalytic coating.

4. The engine as claimed in claim 1, wherein less than one sixth of a surface of the injection device which projects into the combustion chamber has the catalytic coating.

5. The engine as claimed in claim 1, wherein the electric heating device is integrated into the injection device in such a way that a component temperature is increased substantially in a region of the catalytic coating.

6. The engine as claimed in claim 1, wherein the electric heating device is coupled to the catalytic coating and positioned at the tip region, the tip region including nozzle openings, and the catalytic coating adjacent to the nozzle openings of the tip region.

7. A method for an engine comprising:

increasing a temperature of an injection device in a region of a catalytic coating at a tip region on the injection device using an electric heating device in response to a determination by a controller that an amount of coking residue on the injection device is greater than a threshold.

8. The method as claimed in claim 7, wherein increasing the temperature of the injection device is initiated at low load and low rotational speed of the engine.

9. The method as claimed in claim 7, wherein increasing the temperature of the injection device is initiated during a warm-up phase after a cold start, the method further comprising determining the amount of coking residue based on a plurality of parameters via an engine controller.

10. The method as claimed in claim 7, further comprising increasing an injection pressure with which the injection device injects fuel responsive to electrical heating.

11. The method as claimed in claim 7, further comprising initiating knocking combustion during electrical heating.

12. The method as claimed in claim 7, wherein increasing the temperature of the injection device further comprises raising a temperature of cooling liquid in a liquid-type cooling arrangement.

13. The method as claimed in claim 7, wherein increasing the temperature of the injection device further comprises bypassing a charge-air cooling arrangement.

14. A system, comprising:

an injection device;

an electric heating device integrated at a tip region of the injection device;

a catalytic coating at the tip region of the injection device; and a controller suitable to initiate a cleaning mode of the injection device with electric heating of the device to increase a temperature of the catalytic coating on the injection device in response to a determination by the controller that an estimated amount of coking residue on the injection device is greater than a first threshold.

15. The system as claimed in claim 14, wherein the tip region of the injection device with the catalytic coating is smaller than an entire surface of the injection device which projects into a combustion chamber.

16. The system as claimed in claim 14, wherein the cleaning mode is initiated when an engine is under a load less than a lower load threshold and a rotational speed less than a lower speed threshold.

17. The system as claimed in claim 14, wherein the cleaning mode is initiated when an engine is operated for a duration greater than a threshold duration.

18. The system as claimed in claim 14, wherein the cleaning mode is terminated when the estimated amount of coking residue is below a second threshold.

19. The system as claimed in claim 14, wherein the estimated amount of coking residue is determined based on engine operating conditions including engine load, engine speed, air-fuel ratio, time elapsed since last injection device heating phase, and/or an input from one or more sensors.

20. The system as claimed in claim 14, wherein the cleaning mode further comprises initiation of knocking combustion during the electric heating.

* * * * *